US010385760B2

(12) United States Patent
Quevallier et al.

(10) Patent No.: US 10,385,760 B2
(45) Date of Patent: Aug. 20, 2019

(54) COOLING CIRCUIT FOR A MOTOR VEHICLE

(71) Applicant: NOVARES France, Clamart (FR)

(72) Inventors: Jean-Claude Quevallier, Lesquin (FR); Steeve Lariviere, Avion (FR)

(73) Assignee: NOVARES FRANCE, Clamart (FR)

( * ) Notice: Subject to any disclaimer, the term of this patent is extended or adjusted under 35 U.S.C. 154(b) by 0 days.

(21) Appl. No.: 15/775,989

(22) PCT Filed: Nov. 9, 2016

(86) PCT No.: PCT/FR2016/052905

§ 371 (c)(1),
(2) Date: Nov. 12, 2018

(87) PCT Pub. No.: WO2017/081407

PCT Pub. Date: May 18, 2017

(65) Prior Publication Data

US 2019/0120120 A1 Apr. 25, 2019

(30) Foreign Application Priority Data

Nov. 13, 2015 (FR) ..... 15 60868

(51) Int. Cl.
*F01P 7/16* (2006.01)
*F01P 11/02* (2006.01)
*F01P 7/14* (2006.01)

(52) U.S. Cl.
CPC ..... *F01P 7/165* (2013.01); *F01P 11/028* (2013.01); *F01P 2007/146* (2013.01); *F01P 2050/24* (2013.01)

(58) Field of Classification Search
CPC .... F01P 7/165; F01P 11/028; F01P 2007/146; F01P 2050/24
See application file for complete search history.

(56) References Cited

U.S. PATENT DOCUMENTS 4,913,107 A * 4/1990 Schweiger ..... F01P 11/0247 123/41.1
7,128,025 B1 * 10/2006 Westhoff, Jr. ..... F01P 3/202 123/41.01

(Continued)

FOREIGN PATENT DOCUMENTS

DE 102011056282 A1 6/2013
GB 2101293 A 1/1983

(Continued)

OTHER PUBLICATIONS

English Machine Translation to DE102011056282.
English Machine Translation to GB2101293.
English Machine Translation to JPH10266856.

(Continued)

*Primary Examiner* — Thomas N Moulis
(74) *Attorney, Agent, or Firm* — Cantor Colburn LLP

(57) ABSTRACT

The invention relates to a cooling circuit (1) which comprises a first cooling loop I designed to provide thermal control of a first member and at least one second cooling loop II, III designed to provide thermal control of a second member; moreover, the cooling circuit (1) comprises a single degassing tank (6) in fluid connection with the first loop and with the at least one second cooling loop II, III and an isolating valve (70, 700) inserted between the degassing tank (6) and the at least one second cooling loop II, III designed for selectively blocking the flow between the degassing tank 6 and the at least one second cooling loop II, III.

20 Claims, 2 Drawing Sheets

(56) References Cited

U.S. PATENT DOCUMENTS

| | | | | |
|---|---|---|---|---|
| 8,215,427 | B2 | 7/2012 | Rouaud et al. | |
| 10,207,567 | B2 * | 2/2019 | Porras | F01P 11/04 |
| 2003/0127528 | A1 | 7/2003 | Sabhapathy et al. | |
| 2008/0066697 | A1 * | 3/2008 | Raab | F01P 3/12 123/41.55 |
| 2009/0308335 | A1 * | 12/2009 | Dipaola | F01P 7/165 123/41.1 |
| 2010/0012054 | A1 * | 1/2010 | Justin | F01P 3/18 123/41.1 |
| 2010/0050960 | A1 * | 3/2010 | Araki | F01P 7/165 123/41.1 |
| 2013/0255605 | A1 * | 10/2013 | Jentz | F01P 11/16 123/41.15 |
| 2016/0186648 | A1 * | 6/2016 | Rollinger | F01P 11/18 123/41.15 |
| 2017/0361698 | A1 * | 12/2017 | Hussain | B60K 11/02 |
| 2018/0051620 | A1 * | 2/2018 | Lee | F02M 26/32 |
| 2018/0100709 | A1 * | 4/2018 | Gopal | F28D 20/02 |

FOREIGN PATENT DOCUMENTS

| | | | |
|---|---|---|---|
| JP | 10266856 | A | 10/1998 |
| WO | 2007031670 | A1 | 3/2007 |
| WO | 2015080659 | A1 | 6/2015 |

OTHER PUBLICATIONS

English Machine Translation to WO2007031670.
English Machine Translation to WO2015080659.
International Search Report for Application No. PCT/FR2016/052905.

* cited by examiner

I
II
III
1
2
3
4
5
6
20
30
40
50
70
200
300
400
500
700

COOLING CIRCUIT FOR A MOTOR VEHICLE

CROSS REFERENCE TO RELATED APPLICATIONS

This application is a National Stage of PCT Application No. PCT/FR2016/052905 filed on Nov. 9, 2016, which claims priority to French Patent Application No. 15/60868 filed on Nov. 13, 2015, the contents each of which are incorporated herein by reference thereto.

TECHNICAL FIELD

The present invention concerns a cooling device and a cooling method for motor vehicles.

BACKGROUND

New technologies implemented to reduce the consumption of motor vehicles and their pollutant emissions often require multiple circuits or loops for regulating the temperature.

By thermal regulation loop is meant a circuit in which circulates a coolant which regulates the temperature of a mechanical member by conveying the thermal energy produced by the operation of this member.

For example, on a hybrid-type vehicle, two, three or four regulation loops can be found which are each dedicated to the cooling of a particular member with has a specific requirement in terms of thermal management.

By way of example, a vehicle of this type may have:

- a high temperature regulation loop for regulating the temperature of the heat engine,
- a low temperature regulation loop for regulating the temperature of the power electronic members of the electric propulsion chain,
- a very low temperature regulation loop for regulating the temperature of the propulsion battery.

For reasons of compactness and cost limitation, some equipment, such as the degassing tank, may be shared with several regulation loops.

Degassing is an important function during which the air or gas bubbles that are present in the coolant are purged.

Degassing is an important function because the presence of air bubbles in the coolant has a deleterious effect on the quality of the cooling, and therefore does not allow engine operation in optimal conditions, which can lead to uncontrolled thermal conditions with consequences in terms of reliability or durability of the members and in terms of pollution for the environment.

In practice, it should be noted that the sharing of a degassing tank with several cooling loops is not without problems.

Indeed, the use of a single degassing tank for several cooling loops that are at different temperatures, 90/110° C. for a high temperature loop and 60° C. and 30° C. for low or very low temperature loops, has the direct consequence of disturbing the regulation of temperature that occurs in the low temperature regulation loops. In fact, the high temperature regulation loop will make a continuous supply of high temperature liquid in the lower temperatures loop(s).

Moreover, when operating at their respective nominal temperatures, the high temperature regulation loop has a constant need for degassing because the coolant which is in contact with hot spots of the engine—cylinder head cooling—can be vaporized punctually and therefore generate gas bubbles while the low or very low temperature regulation loops have a need for degassing at startup but do not generate gas bubbles during their operation. In other words, once the rise in temperature up to the nominal operating temperature is achieved, a degassing tank shared with a high temperature cooling loop and to one or more lower temperature cooling loop(s) turns out to have a deleterious effect on the cooling operation at lower temperature.

Degassing loop closing devices are already known for example from the document FR 2 949 509-A1 which are, however, inappropriate for the management of multiple cooling loops and their degassing problem.

BRIEF SUMMARY

In this technical context, an aim of the invention is to propose a cooling circuit with several cooling loops pooling the degassing tank without compromising the operation of each cooling loop.

For this purpose, the invention concerns a cooling circuit for a motor vehicle comprising a first cooling loop designed to ensure thermoregulation of a first member and at least one second cooling loop designed to ensure thermoregulation of a second member. According to a general definition of the invention, the cooling circuit comprises a single degassing tank fluidically connected to the first loop and to, at least one, second cooling loop and an isolation valve interposed between the degassing tank and at least one second cooling loop designed to selectively occlude the flow between the degassing tank and at least one second cooling loop.

The isolation valve may comprise at least one heat-sensitive bimetal element designed to act on a shutter to switch the isolation valve from a conductive position to a non-conductive position when the coolant passing through the isolation valve reaches a trigger temperature.

The isolation valve can be integrated into a thermostat housing that regulates the temperature of the, at least one, second cooling loop.

According to one possible embodiment, the thermostat housing comprises a tapping in communication with the degassing tank.

The thermostat housing may comprise a cavity in which are disposed one or more bimetal element(s) whose triggering switches a shutter such as a ball from a position in which the shutter enables the passage of the coolant to a position in which the shutter blocks the passage of the coolant.

The trigger temperature of the isolation valve may be equal to or greater than the nominal operating temperature of the, at least one, second cooling loop.

According to one possible embodiment, the cooling circuit comprises a first high temperature cooling loop, a second low temperature cooling loop and a third very low temperature cooling loop.

Each cooling loop may comprise at least one element of the group comprising an exchanger, a radiator, a pump, a thermostat housing.

BRIEF DESCRIPTION OF THE DRAWINGS

For a good understanding, the invention is described with reference to the appended figures wherein.

DETAILED DESCRIPTION

Figure 1:
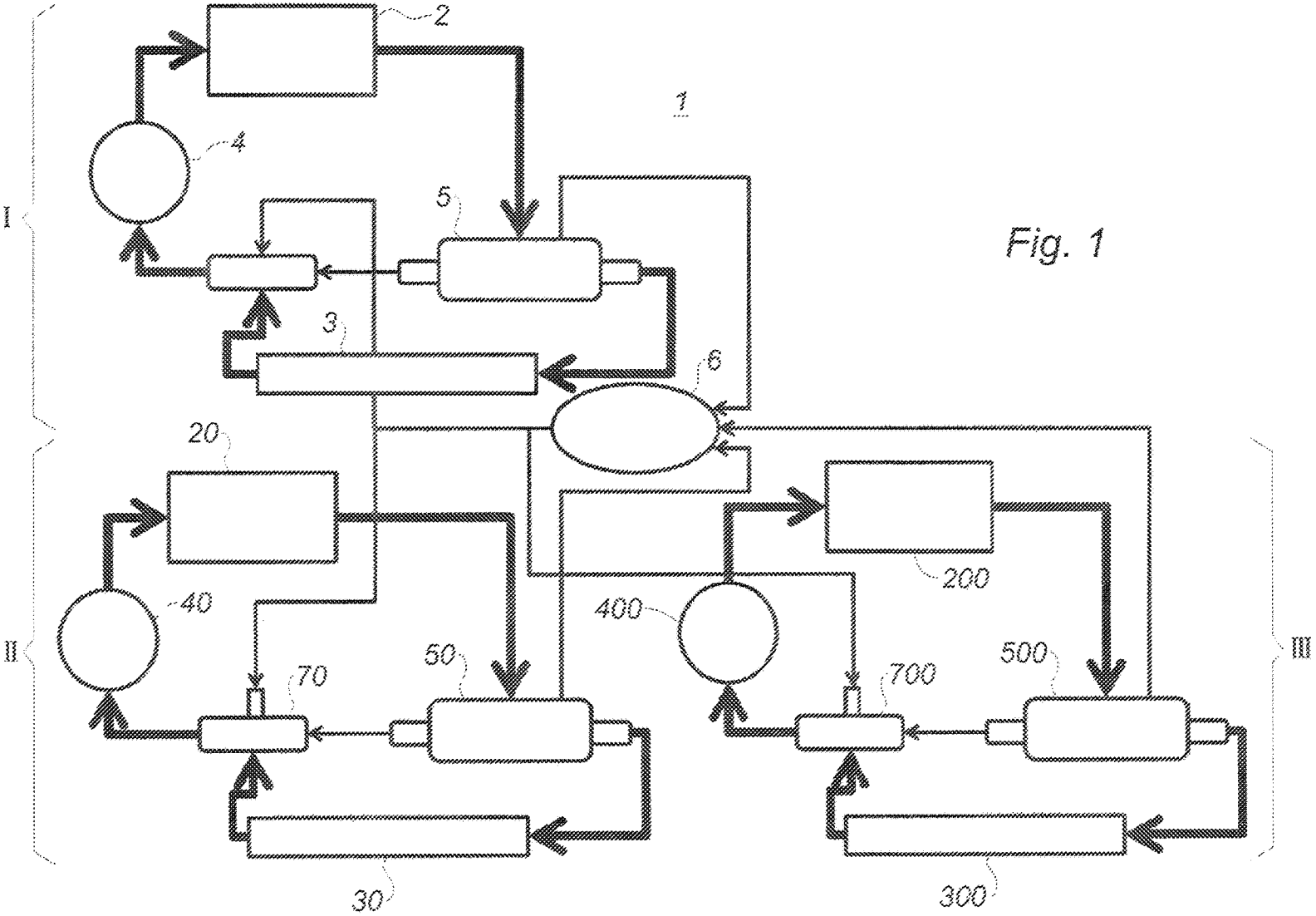
FIG. 1 shows schematically an embodiment of a cooling circuit according to the invention.

The invention proposes a cooling circuit 1 for a vehicle comprising several cooling loops. In the example shown in the drawing, the cooling circuit 1 comprises three cooling loops namely: a high temperature cooling loop I, a low temperature cooling loop II and a very low temperature cooling loop III.

The high temperature cooling loop I comprises a high temperature exchanger 2 composed of the heat engine of the vehicle, a high temperature radiator 3. A pump 4 ensures the circulation of a glycol type coolant. The presence of a thermostat regulation housing 5 is also noted, which allows driving the coolant circuit as a function of the temperature.

A tapping is provided on the thermostat housing 5 to achieve a connection with a degassing tank 6.

The low temperature cooling loop II comprises a low temperature exchanger 20 with, for example, the power electronic members (inverter, charger . . . ) of the electric propulsion chain, a low temperature radiator 30. A pump 40 ensures the circulation of the coolant. The low temperature cooling loop II is also equipped with a thermostat regulation housing 50 which allows driving the coolant circuit as a function of the temperature.

A tapping is provided on the thermostat housing 50 to achieve a connection with the degassing tank 6.

The presence of a temperature-driven isolation valve 70 on the backflow branch is noted, which ensures the backflow of the coolant downstream of the degassing tank 6. The function of this isolation valve 70 will be described in detail later.

The very low temperature cooling loop III comprises a very low temperature exchanger 200 with, for example, the battery of the electric propulsion chain and a very low temperature radiator. A pump 400 ensures the circulation of the coolant. The very low temperature cooling loop III is also equipped with a thermostat regulation housing 500 which allows driving the coolant circuit as a function of the temperature.

A tapping is provided on the very low temperature thermostat housing 500 to make a connection with the degassing tank 6.

Note the presence of an isolation valve 700 on the backflow branch which ensures the backflow of the coolant downstream of the degassing tank 6. The function of this isolation valve will be described in detail later.

It can be noticed then that the cooling device which comprises three cooling loops has a single degassing tank 6 which is therefore shared with the three degassing loops.

The operation of the cooling device is as follows.

During the operation of the vehicle, the three cooling loops I, II, III come into action to regulate the temperature of each of the members assigned thereto.

Each of the three cooling loops I, II, III has a need for degassing which is satisfied by the connection of each of the cooling loops to the degassing tank 6.

During the temperature rise to their respective nominal operating temperatures typically 90° C.-110° C. for the high temperature loop I, 55° C.-65° C. for the loop, the low temperature coolant II and 30° C.-40° C. for the very low temperature loop III, the coolant of each of the high temperature, low temperature and very low temperature cooling loops is purged of its gas bubbles which contributes to an optimal operation of the vehicle.

When the temperatures of the coolant of the low temperature loop II and of the very low temperature loop III reach their nominal operating values, the temperature-driven isolation valves 70 and 700 take the closed position because the trigger temperature of the isolation valve 70 of the low temperature loop II corresponds to the nominal operating temperature of this loop and the trigger temperature of the isolation valve 700 of the very low temperature loop III corresponds to the nominal operating temperature of this loop.

Thus, the degassing tank 6 which is unique and which is shared with all three cooling loops I, II, III is isolated from the low temperature loop II and the very low temperature loop III. In this configuration, the degassing tank is therefore only in connection with the high temperature cooling loop I.

The isolation of the very low temperature loop III compared to the degassing tank 6 is usually done before the isolation of the low temperature loop II relative to the degassing tank 6 because the coolant in the very low temperature loop III reaches its nominal operating temperature before the coolant in the low temperature loop II reaches its nominal operating temperature.

In nominal operation, the low temperature II and very low temperature III cooling loops do not generate any gas bubble in their coolant because, unlike the high temperature cooling loop I, there is no boiling of the coolant.

In one embodiment (not shown), the driving of the insolation valves can be done by solenoid valves driven by temperature probes.

In another embodiment which is less expensive than the preceding one, the driving of the isolation valves can be done mechanically by a temperature sensitive element (wax capsule, shape memory material or bimetal).

Figure 4:
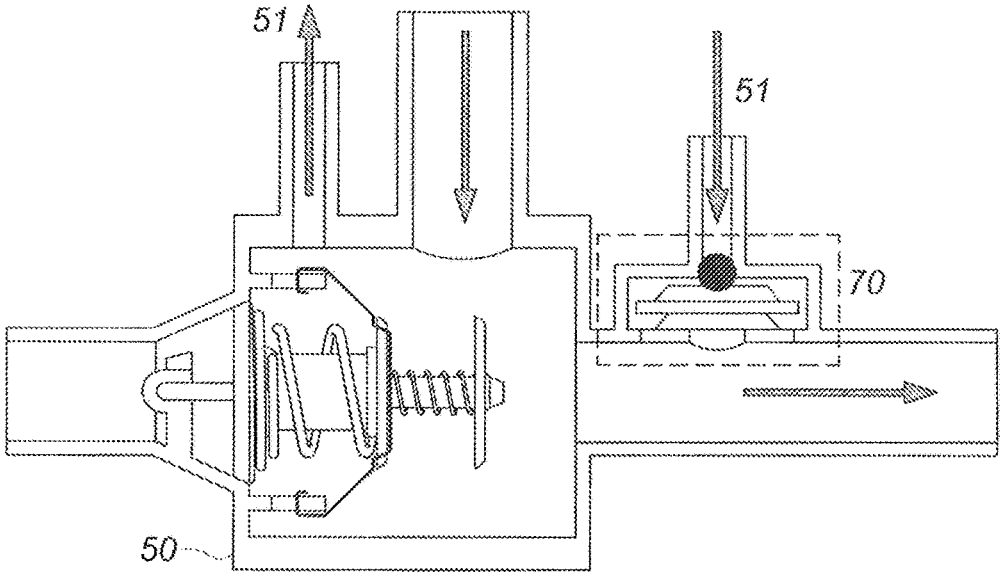
FIG. 4 shows an embodiment of a thermostat housing according to the invention.

In practice, the isolation valve 70, 700 can be incorporated to the thermostat housing 50, 500 as shown in FIG. 4.

The thermostat housing has, conventionally, an inlet and an outlet for the circulation of the fluid to be regulated.

In addition and specifically to the invention, the thermostat housing 50, 500 is then equipped with an outflow and a backflow 51 from the degassing tank 6.

Figure 2:
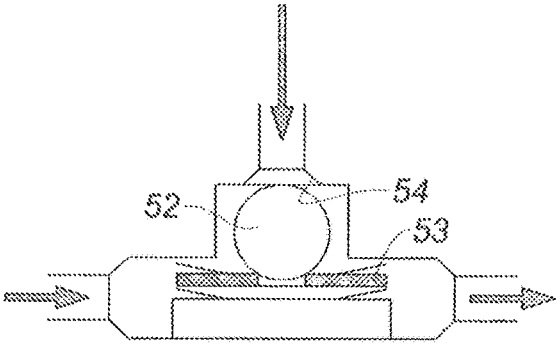
FIGS. 2 and 3 show schematically the principle of an insolation valve.

The control of the backflow from the water tank is done by a shutter such as a flap or a ball 52 which rests on one or more bimetal element(s) 53 as can be seen in FIG. 2. The ball 52 is possibly held against the bimetal elements(s) 53 by a spring. The stack of bimetal elements 53 and possibly the spring are calibrated for a triggering at a trigger temperature that corresponds to the nominal temperature of the cooling loop in question. The flap, the bimetal elements and the possible return spring are housed in a cavity formed in the thermostat housing.

In other words, the isolation valve 50, 500 is conductive when the temperature is below the nominal operating temperature of the coolant and becomes non-conductive when the temperature of the coolant reaches a trigger value which corresponds to a determined temperature according to the nominal operating temperature of the low temperature cooling loop II or very low temperature III cooling loop.

In the temperature rise phase, as shown in FIG. 2, the isolation valve lets the coolant flow back from the degassing tank 6 which joins the coolant of the low temperature II or very low temperature III loop.

Indeed, during this phase, the coolant of the low temperature cooling loop II and/or very low temperature cooling loop III can be charged with gas bubbles that should be get rid of, for an optimal operation of the various members of the vehicle.

Given the thermal energy releases by the different members such as inverter, battery etc., the temperature of the coolant has reached its nominal temperature after a variable operation period.

Figure 3:
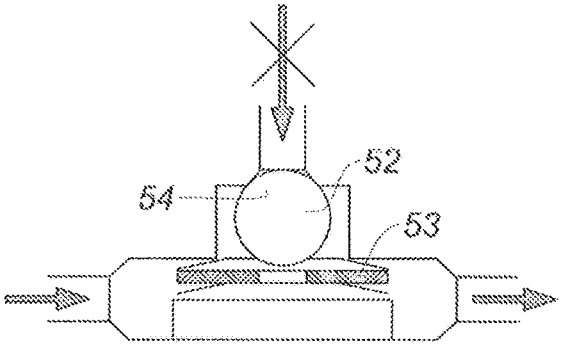

FIG. 3 thus shows the isolation valve 50 in a configuration in which the valve blocks the backflow from the degassing tank 6.

The coolant having reached a nominal operating temperature, the ball 52 is pushed against its seat 54 under the action of the bimetal elements and blocks the flow coming from the degassing tank 6. The coolant is thus used as a driver of the isolation valve.

The resetting of the valve is done when the temperature of the coolant decreases.

Another advantage of the bimetal element stems from the hysteresis of these elements. Indeed, the hysteresis of the bimetal elements is, according to the mounting and pre-charge conditions, of about 20° C. If the difference between the nominal trigger temperatures and the regulation temperature of the cold coolant is below 20° C., the temperature of the cold coolant can be used as a reset condition.

This can be advantageous in the case of devices operating at low temperature (for example below 40° C.) whose operation can be disturbed by the ambient temperature which can be higher. Indeed, if the bimetal elements are no longer irrigated by the "driver" fluid, a rise in ambient temperature can prevent the resetting of the flap. This may be the case for example if the vehicle is parked in summer in the sunlight. In addition, the temperature under the hood rises commonly up to 80° C. in common use, in this case during a hot start, the degassing will not occur, even if the low temperature loop is below its regulation temperature.

According to the architecture of the vehicle, the low or very low temperature isolation valve can be integrated to the thermostat housing or can be an independent element which is placed on the cooling loop.

Of course, the invention is not limited to the embodiments described above by way of non-limiting example but it embraces all the alternative embodiments. Thus, the triggering of the isolation valve could be made by a heat-sensitive wax element or a shape memory alloy.

The invention claimed is:

1. A cooling circuit for a motor vehicle comprising a first cooling loop I designed to provide the thermoregulation of a first member and at least one second cooling loop II, III designed to ensure the thermoregulation of a second member, wherein the cooling circuit comprises a single degassing tank fluidically connected to the first loop and to, the at least one, second cooling loop II, III and an isolation valve interposed between the degassing tank and the at least one second cooling loop II, III designed to selectively occlude the flow between the degassing tank 6 and the at least one second cooling loop II, III, wherein the isolation valve comprises at least one bimetal heat-sensitive element designed to act on a shutter to switch the isolation valve from a conductive position to a non-conductive position when the coolant passing through the isolation valve reaches a trigger temperature.

2. The cooling circuit according to claim 1, wherein the isolation valve is integrated to a thermostat housing which regulates the temperature of the, at least one, second cooling loop II, III.

3. The cooling circuit according to claim 2, wherein the thermostat housing comprises a tapping in communication with the degassing tank.

4. The cooling circuit according to claim 3, wherein the thermostat housing comprises a cavity in which are disposed one or more bimetal elements whose triggering switches a shutter such as a ball from a position in which the shutter enables the passage of the coolant to a position in which the shutter blocks the passage of the coolant.

5. The cooling circuit according to claim 1, wherein the trigger temperature of the isolation valve is equal to or greater than the nominal operating temperature of the, at least one, second cooling loop.

6. The cooling circuit (1) according to any of claim 1, wherein the cooling circuit (1) comprises a first high temperature cooling loop I, a second low temperature cooling loop II and a third very low temperature cooling loop III.

7. The cooling circuit (1) according to claim 1, wherein each cooling loop I, II, III comprises at least one element of the group comprising an exchanger, a radiator, a pump, a thermostat housing.

8. The cooling circuit according to claim 2, wherein the trigger temperature of the isolation valve is equal to or greater than the nominal operating temperature of the, at least one, second cooling loop.

9. The cooling circuit according to claim 3, wherein the trigger temperature of the isolation valve is equal to or greater than the nominal operating temperature of the, at least one, second cooling loop.

10. The cooling circuit according to claim 4, wherein the trigger temperature of the isolation valve is equal to or greater than the nominal operating temperature of the, at least one, second cooling loop.

11. The cooling circuit (1) according to claim 2, wherein the cooling circuit (1) comprises a first high temperature cooling loop I, a second low temperature cooling loop II and a third very low temperature cooling loop III.

12. The cooling circuit (1) according to claim 3, wherein the cooling circuit (1) comprises a first high temperature cooling loop I, a second low temperature cooling loop II and a third very low temperature cooling loop III.

13. The cooling circuit (1) according to claim 4, wherein the cooling circuit (1) comprises a first high temperature cooling loop I, a second low temperature cooling loop II and a third very low temperature cooling loop III.

14. The cooling circuit (1) according to claim 5, wherein the cooling circuit (1) comprises a first high temperature cooling loop I, a second low temperature cooling loop II and a third very low temperature cooling loop III.

15. The cooling circuit according to claim 2, wherein each cooling loop I, II, III comprises at least one element of the group comprising an exchanger, a radiator, a pump, a thermostat housing.

16. The cooling circuit according to claim 3, wherein each cooling loop I, II, III comprises at least one element of the group comprising an exchanger, a radiator, a pump, a thermostat housing.

17. The cooling circuit according to claim 4, wherein each cooling loop I, II, III comprises at least one element of the group comprising an exchanger, a radiator, a pump, a thermostat housing.

18. The cooling circuit according to claim 5, wherein each cooling loop I, II, III comprises at least one element of the group comprising an exchanger, a radiator, a pump, a thermostat housing.

19. The cooling circuit according to claim 6, wherein each cooling loop I, II, III comprises at least one element of the group comprising an exchanger, a radiator, a pump, a thermostat housing.

20. A cooling circuit for a motor vehicle comprising a first cooling loop I designed to provide the thermoregulation of a first member and at least one second cooling loop II, III designed to ensure the thermoregulation of a second member, wherein the cooling circuit comprises a single degassing tank fluidically connected to the first loop and to, the at least one, second cooling loop II, III and an isolation valve interposed between the degassing tank and the at least one second cooling loop II, III designed to selectively occlude the flow between the degassing tank and the at least one second cooling loop II, III, wherein the cooling circuit comprises a first high temperature cooling loop I, a second low temperature cooling loop II and a third very low temperature cooling loop III.

* * * * *